US009553362B2

(12) United States Patent
Inoue et al.

(10) Patent No.: US 9,553,362 B2
(45) Date of Patent: Jan. 24, 2017

(54) ARRAY ANTENNA DEVICE

(71) Applicants: Furukawa Electric Co., Ltd., Tokyo (JP); Furukawa Automotive Systems Inc., Shiga (JP)

(72) Inventors: Daisuke Inoue, Tokyo (JP); Masayuki Nagata, Tokyo (JP)

(73) Assignees: FURUKAWA ELECTRIC CO., LTD., Tokyo (JP); FURUKAWA AUTOMOTIVES SYSTEMS INC., Shiga (JP)

( * ) Notice: Subject to any disclaimer, the term of this patent is extended or adjusted under 35 U.S.C. 154(b) by 53 days.

(21) Appl. No.: 14/718,818

(22) Filed: May 21, 2015

(65) Prior Publication Data

US 2015/0255867 A1 Sep. 10, 2015

Related U.S. Application Data

(63) Continuation of application No. PCT/JP2013/081299, filed on Nov. 20, 2013.

(30) Foreign Application Priority Data

Nov. 23, 2012 (JP) ..... 2012-256976

(51) Int. Cl.
*H01Q 3/26* (2006.01)
*H01Q 13/20* (2006.01)
(Continued)

(52) U.S. Cl.
CPC ..... *H01Q 3/26* (2013.01); *H01Q 1/38* (2013.01); *H01Q 13/206* (2013.01); *H01Q 21/065* (2013.01)

(58) Field of Classification Search
USPC ..... 343/700 MS, 853
See application file for complete search history.

(56) References Cited

U.S. PATENT DOCUMENTS 3,995,277 A * 11/1976 Olyphant, Jr. ..... H01Q 13/206 343/846
4,180,817 A * 12/1979 Sanford ..... H01Q 13/206 342/375
(Continued)

FOREIGN PATENT DOCUMENTS

JP 04-122103 A 4/1992
JP 2000-101341 A 4/2000
(Continued)

OTHER PUBLICATIONS

International Search Report mailed Feb. 18, 2014 for International Application No. PCT/JP2013/081299, 2 pages (with translation).

*Primary Examiner* — Howard Williams
(74) *Attorney, Agent, or Firm* — Amin, Turocy & Watson, LLP

(57) ABSTRACT

[Object] To provide an antenna device which has a radiation pattern of wide angle, does not generate nulls in the vicinity of a front of an antenna, and has a high radiation efficiency.

[Organization] An array antenna device 1 having a plurality of radiation elements has: a dielectric substrate 2; two or more series array antennas 10, 20 which are formed on the dielectric substrate and to which the plurality of radiation elements 11 to 13, 21 to 23 are connected in series by conductor lines 15, 25; a distributor 30 formed in a layer different from a layer of the dielectric substrate where the series array antennas are formed, the distributor distributing power via capacitive coupling to the two or more series array antennas; and a phase adjuster (conductor lines 34 to 37) adjusting a phase of power distributed by the distributor.

10 Claims, 15 Drawing Sheets

(51) Int. Cl.
*H01Q 21/06* (2006.01)
*H01Q 1/38* (2006.01)

(56) References Cited

U.S. PATENT DOCUMENTS

| | | | | |
|---|---|---|---|---|
| 6,100,846 | A * | 8/2000 | Li | H01Q 1/38 343/700 MS |
| 6,239,762 | B1 * | 5/2001 | Lier | H01Q 13/10 343/700 MS |
| 7,920,094 | B2 * | 4/2011 | Hansen | H01Q 9/045 343/700 MS |
| 2007/0279303 | A1 * | 12/2007 | Schoebel | H01Q 21/0075 343/713 |

FOREIGN PATENT DOCUMENTS

| | | | |
|---|---|---|---|
| JP | 2004-221877 | A | 8/2004 |
| JP | 2004-260554 | A | 9/2004 |
| JP | 2008-029015 | A | 2/2008 |

* cited by examiner

ARRAY ANTENNA DEVICE

CROSS-REFERENCE TO RELATED APPLICATIONS

This application is a continuation of International Application No. PCT/JP2013/081299, filed Nov. 20, 2013, and entitled "ARRAY ANTENNA DEVICE", which claims priority from Japanese Patent Application No. 2012-256976, filed Nov. 23, 2012, the disclosures of each of which are incorporated herein by reference in their entireties.

TECHNICAL FIELD

The present invention relates to an array antenna in which plural wide-angle antennas applicable to a device radiating radio waves are disposed, and relates to a wide-angle antenna and an array antenna which are preferred for applications to a radar device mounted in an automobile, and the like.

BACKGROUND ART

Applications of radars for detecting human/object or the like are spreading in various fields. Among others, in order to aid safe driving of automobile, developments of devices for monitoring an obstacle or the like (target object) existing in the periphery of an automobile using a radar are in progress. As such an automobile peripheral monitoring radar, BSD (Blind Spot Detection) aiding blind spot detection, and CTA (Cross Traffic Alert) which generates an alarm when a person, an oncoming car, or the like exists at an intersection, and the like are being brought into practical use. Among these automobile peripheral monitoring radars, there are ones required to detect a target object in the range of a substantially fan shape constituted of a range of certain angle (for example, in a wide angle range of about −60° to +60° with the front of a radiation direction being a center). On the other hand, other than automobiles, there are cases where a wide-angle detection range is required similarly as an application example to an infrastructure intended for security purpose or monitoring purpose. In any case, increase in angle range is necessary, but simultaneously there may be cases where ones having no drop in characteristics within the angle range and ones which have symmetrical detection ranges are preferred.

Patent Document 1 discloses an array antenna with plural radiation patterns having main lobes in which radiation intensity peaks in plural directions and a sensor detecting a predetermined wide angle direction. For is this array antenna, there is presented a case example of power feeding in reverse phase as a feeding condition and about 0.5 and 0.2 as an amplitude ratio, where it is possible to form a radiation pattern in a wide angle direction instead of directivity toward the front.

Further, Patent Document 2 discloses a microstrip array antenna in which plural radiation elements are coupled by a directional coupler of ¼ wavelength side coupling form. As disclosed in the "Prior Art" section in this Patent Document 1, when a T-branched line of simple structure is used to constitute a power feeding circuit, due to the influence of radiation elements or reflection waves of power feeding lines, power distribution characteristics of the T-branched line deviates from a desired value, and an excitation distribution of respective radiation elements is disturbed from the desired value, which can deteriorate radiation characteristics of the antenna. However, the technology described in Patent Document 2 allows preventing such deterioration in radiation characteristics.

PRIOR ART DOCUMENT

Patent Document

Patent Document 1: Japanese Patent Application Laid-open No. 2004-260554

Patent Document 2: Japanese Patent Application Laid-open No. 2000-101341

SUMMARY OF THE INVENTION

Problems to be Solved by the Invention

Incidentally, in the technology disclosed by Patent Document 1, although a radiation pattern having peaks at plural specific directions in wide angle can be formed, nulls occur at angles between the specific directions, the radiation pattern are wide angles but do not lead to beam formation without null in the entire angle range.

Further, the technology disclosed by Patent Document 2 uses a directional coupler capable of performing power distribution which is weak to a certain extent, but a loss of the amount of power absorption occurs due to the use of terminating means. Further, the directional coupler is disposed on the same surface as a radiation surface, and thus there is also a problem that unnecessary radiations in the coupler affect antenna radiation characteristics, or the like. Further, there is disclosed no specific structural example of easily adjusting designs and favorably realizing a wide angle in a one-side axis direction simply and compactly.

The present invention has been made in view of the above points, and it is an object thereof to provide an antenna which can obtain a radiation pattern of wide angle without generating nulls and in which losses are reduced as compared to conventional antennas, and an array antenna using the antenna.

Means for Solving the Problems

In order to solve the above problems, the present invention is characterized by an array antenna device having a plurality of radiation elements, the array antenna device having: a dielectric substrate; two or more to series array antennas formed on the dielectric substrate, the two or more series array antennas consisting of the plurality of radiation elements which are connected in series by conductor lines; a distributor formed in a layer different from a layer of the dielectric substrate where the series array antennas are formed, the distributor distributing power via capacitive coupling to the two or more series array antennas; and a phase adjuster adjusting a phase of power distributed by the distributor.

With such a structure, a power distribution ratio with respect to the plurality of antenna elements can be made large, and thus it is possible to adjust a radiation pattern to a wide angle and obtain an antenna which does not generate nulls. Further, to distribute power to the plural antenna elements, no terminating resistor is disposed on the lines, and thus losses due to a terminating resistor can be eliminated, making it possible to improve radiation efficiency of the antenna. At that time, since the directivity formed by the distributor and the phase adjuster is only a one-side axis direction, directivity adjustment including unwanted reflection waves is easy. Moreover, by forming the distributor on a layer different from that of the radiation elements, it is possible to reduce influence on radiation.

Further, one aspect of the present invention is characterized in that the phase adjuster is mounted on an output side where a power distribution ratio of the distributor is relatively small.

With such a structure, it is possible to reduce the influence of impedance changes on the feeding point side.

Further, one aspect of the present invention is characterized in that a line from an output side where a power distribution ratio of the distributor is relatively small to a feeding point of the series array antennas is longer than a line from an output side where the power distribution ratio is relatively large to the feeding point of the series array antennas.

With such a structure, decrease in power due to line lengths can be reduced.

Further, one aspect of the present invention is characterized in that a is power distribution ratio of the distributor is −10 dB or less.

With such a structure, even when it is designed to have a radiation pattern of wide angle, generation of large nulls in this angle range can be suppressed.

Further, one aspect of the present invention is characterized in that the phase adjuster is formed of lines having a bypass.

With such a structure, the phase can be adjusted by a simple structure.

Further, one aspect of the present invention is characterized in that each of the radiation elements constituting the series array antennas has a different width.

With such a structure, side lobes of a gain characteristic can be reduced.

Further, one aspect of the present invention is characterized in that the two or more series array antennas have a substantially symmetrical gain characteristic when a lining direction of the series array antennas is taken as an axis.

With such a structure, when a plurality of array antenna devices are disposed, routing of wires can be simplified.

Further, one aspect of the present invention is characterized in that the series array antennas are applied as a transmission antenna of a radar device.

With such a structure, a radar device having a wide detection angle range and a favorable gain characteristic can be provided.

Further, one aspect of the present invention is characterized in that it has two of the series array antennas as the transmission antenna.

With such a structure, a detection angle range can be made wide and a favorable gain characteristic can be obtained by a simple and small structure, a minimum structure.

Further, one aspect of the present invention is characterized in that it has two of the series array antennas as the transmission antenna and two of the series array antennas as a reception antenna.

With such a structure, a radar device having a wide detection angle range and a favorable gain characteristic can be provided in a substantially mechanically symmetrical structure.

Effect of the Invention

According to the present invention, it becomes possible to provide an array antenna device which has a radiation pattern of wide angle, does not generate nulls in the vicinity of a front of an antenna, and has a high radiation efficiency.

BEST MODE FOR CARRYING OUT THE INVENTION

Next, embodiments of the present invention will be described.

(A) Description of a Structure of an Embodiment

Figure 1:
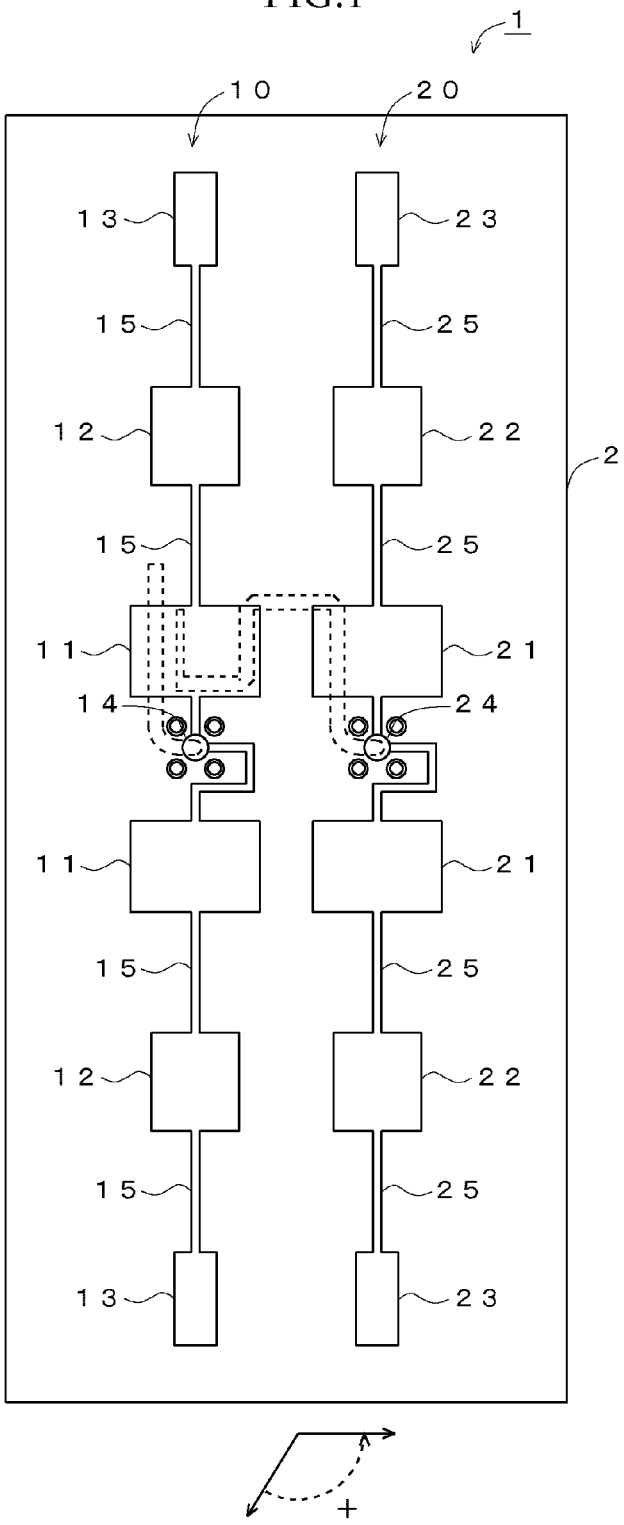
FIG. 1 is a view illustrating a structural example of an array antenna device according to an embodiment of the present invention.

FIG. 1 is a view illustrating a structural example of an array antenna device according to an embodiment of the present invention. In the example illustrated in FIG. 1, the array antenna device 1 has series array antennas 10, 20 which receive a distribution of power by a distributor 30 and are formed on a front surface of a dielectric substrate 2. The series array antenna 10 is connected in series by a conductor line 15 and has radiation elements 11 to 13. In the example of FIG. 1, the radiation elements 11 to 13 have different widths in order to reduce a side lobe in a gain characteristic. The series array antenna 10 is supplied with power via the distributor 30. The series array antenna 20 has a structure similar to the series array antenna 10, and is disposed in a state that the series array antenna 10 is moved in parallel in a direction orthogonal to the conductor line 15. Specifically, the series array antenna 20 includes radiation elements 21 to 23 which are connected in series by a conductor line 25. Similarly to the series array antenna 10, the radiation elements 21 to 23 have different widths for reducing a side lobe in a gain characteristic. The series array antenna 20 is supplied with power via the distributor 30 and a phase adjuster 32.

Figure 2:
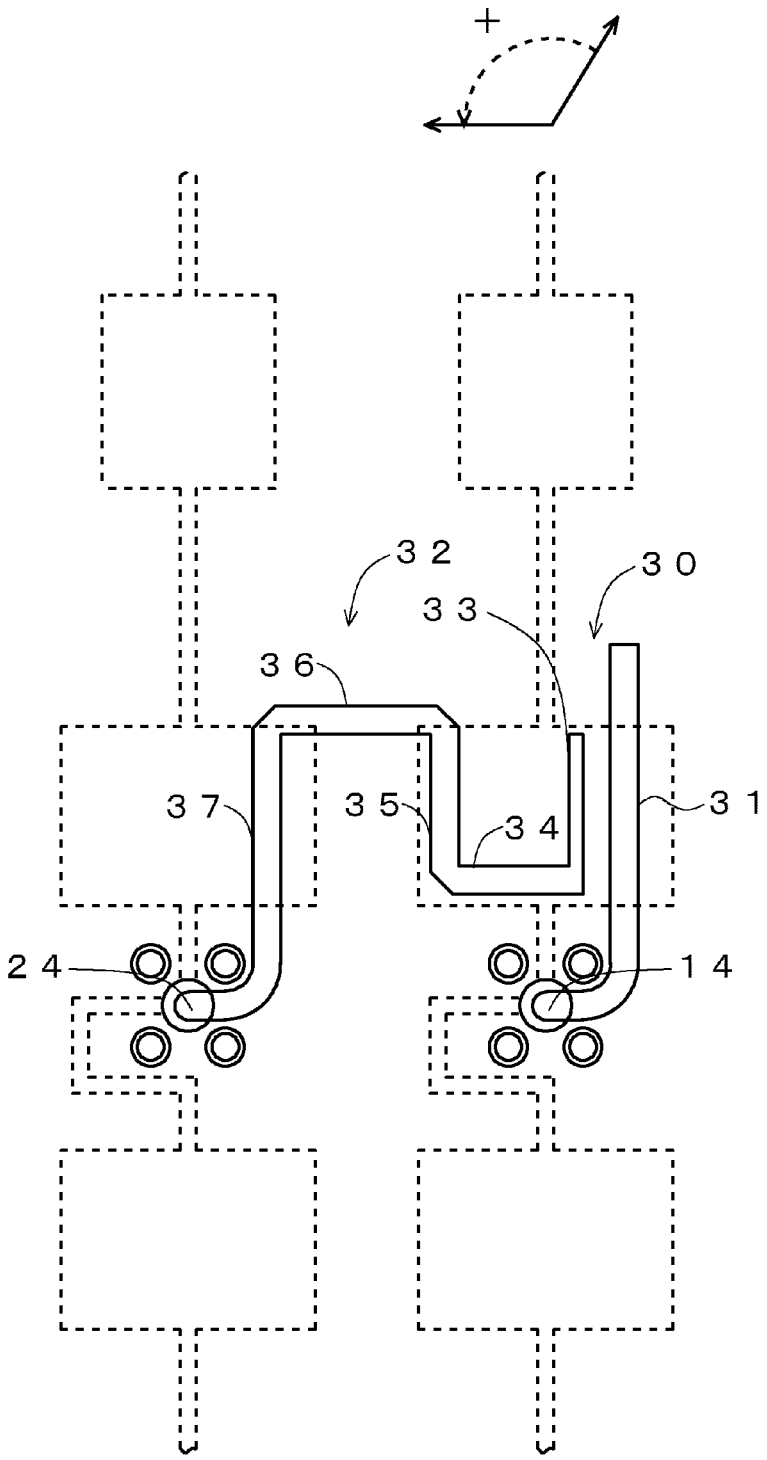
FIG. 2 is a view illustrating the embodiment illustrated in FIG. 1 from a rear side.

FIG. 2 is a view illustrating a structural example of the distributor 30 and the phase adjuster 32. Note that FIG. 2 is a view seeing the dielectric substrate 2 illustrated in FIG. 1 from a rear surface (on a rear side of a face on which the series array antennas 10, 20 illustrated in FIG. 1 are formed). On the rear surface of the dielectric substrate 2, as illustrated in FIG. 2, the distributor 30 and the phase adjuster 32 are disposed. The distributor 30 is constituted of a conductor line 31 having a shape of alphabet "J" connected to a feeding point 14 of the series array antenna 10 and a conductor line 33 disposed in parallel with the conductor line 31. Power inputted to an upper end (upper end of FIG. 2) of the conductor line 31 of this distributor 30 is supplied to the feeding point 14 via the conductor line 31, and is also distributed by a predetermined distribution ratio to the conductor line 33 via capacitive coupling formed between the conductor line 31 and the conductor line 33. The phase adjuster 32 is formed by connecting conductor lines 33 to 37 having a meander structure. The power distributed to the conductor line 33 by the distributor 30 by a predetermined distribution ratio has its phase delayed by the conductor lines 34 to 37 having a meander structure, and thereafter supplied to a feeding point 24. The power supplied to the feeding point 14 is supplied to the radiation elements 11 to 13 by the conductor line 15, and then radiated as radio waves. Further, the power supplied to the feeding point 24 is supplied to radiation elements 21 to 23 by the conductor line 25, and then radiated as radio waves.

(B) Description of Operation of the Embodiment

Figure 3:
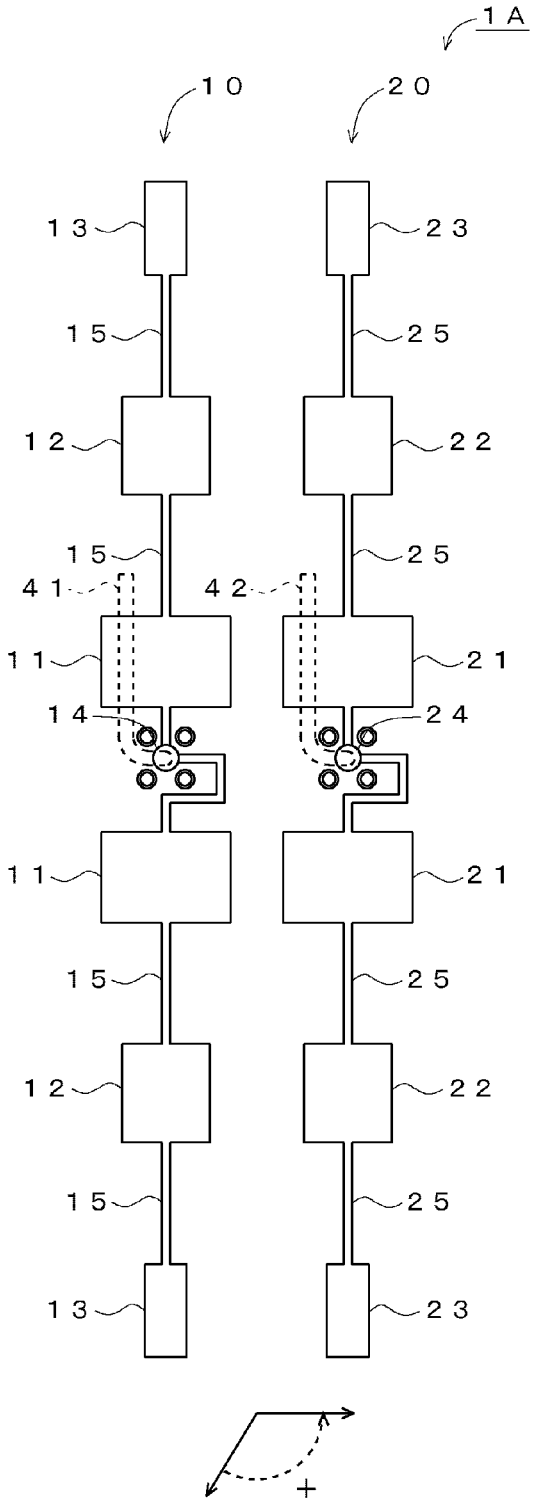
FIG. 3 is a view illustrating a structure of an array antenna device having no distributor.
Figure 4:
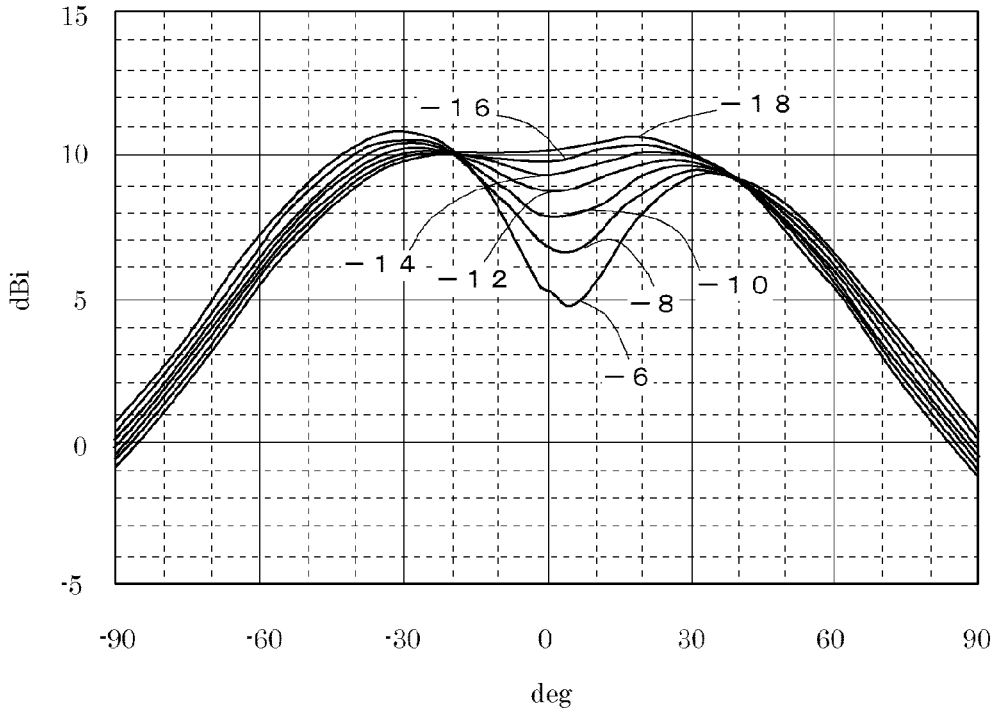
FIG. 4 is a diagram illustrating gain characteristics of the array antenna device illustrated in FIG. 3.

Next, operation of the embodiment illustrated in FIG. 1 will be described. Hereinafter, operation of an array antenna device 1A which does not have the distributor 30 and the phase adjuster 32 will be described with reference to FIG. 3, and thereafter operation of the array antenna device 1 will be described with reference to FIG. 1. FIG. 3 is a structural example of the array antenna device 1A of the case of not having the distributor 30 and the phase adjuster 32 illustrated in FIG. 2. In this example, power is supplied separately to the feeding points 14, 24 by conductor lines 41, 42. FIG. 4 is a diagram illustrating changes in a gain characteristic in the case where the ratios of power supplied to the conductor lines 41, 42 illustrated in FIG. 3 are varied. The horizontal axis of FIG. 4 denotes an angle when a direction illustrated at the bottom of FIG. 3 is plus, and the vertical axis denotes gain dBi. In the diagram, numerals given to curves denote ratios of power supplied to the feeding points 14, 24 by the conductor lines 41, 42. Note that in this example, a phase difference of power P1, P2 supplied to the conductor line 41 and the conductor line 42 (=∠P2−∠P1) is set to −195 (deg.). In this case, when the power supply ratio (=P2/P2 (dB)) is varied as −6 dB, −8 dB, −10 dB, . . . , −18 dB, it can be seen that, as the power distribution ratio increases, the gain characteristic of a null part (a recessed part of a characteristic) in the front (0 (deg.)) becomes flat.

Figure 5:
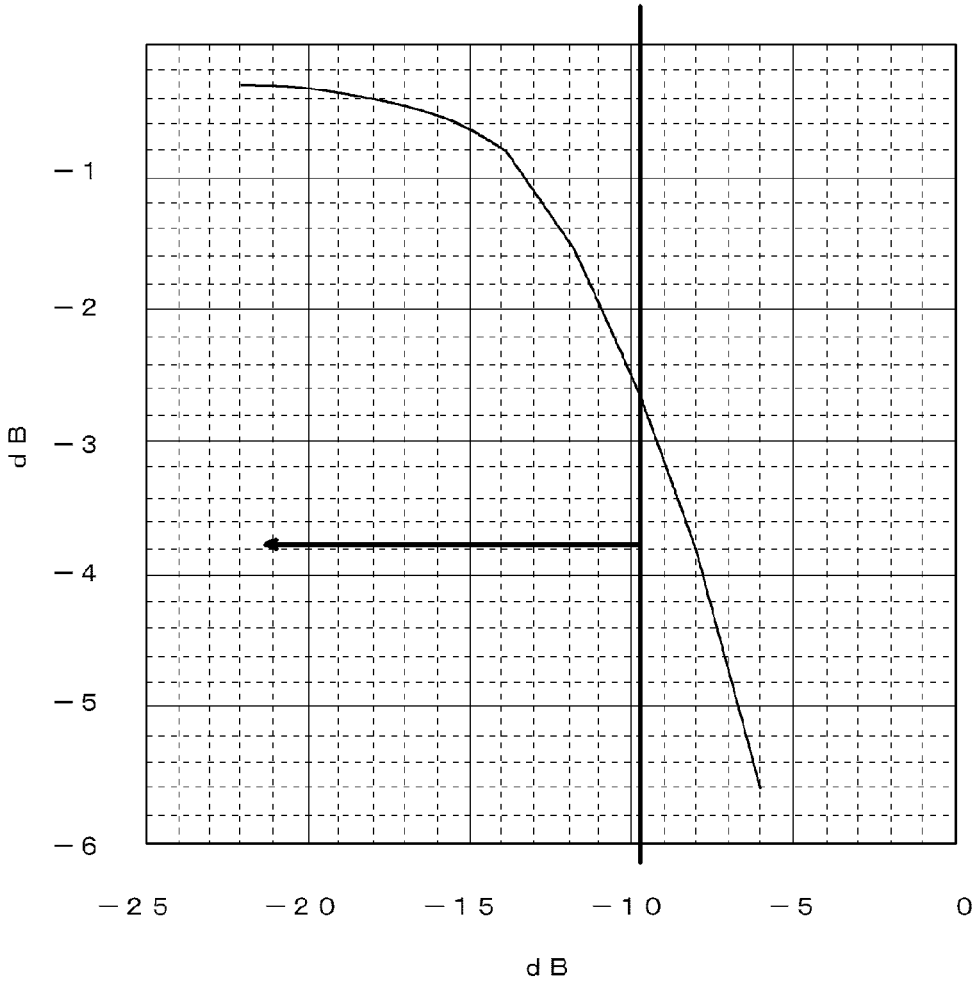
FIG. 5 is a diagram illustrating a difference between a front gain and a peak gain illustrated in FIG. 4 according to changes of a power distribution ratio.

FIG. 5 is a diagram illustrating a difference between a front gain (gain at 0 degree) and a peak gain (peak gain of a curve of FIG. 4) illustrated in FIG. 4 when a power supply ratio is varied. The horizontal axis of FIG. 5 denotes the power supply ratio (dB) and the vertical axis denotes a value obtained by subtracting the peak gain from the front gain. As illustrated in FIG. 5, as the distribution power ratio increases (moves leftward in the diagram), the value obtained by subtracting the peak gain from the front gain decreases. In the practical example including antenna directivity here, it can be seen that the power distribution ratio needs to be larger than −10 dB so as to make the difference between a front gain and a peak gain be −3 dB or less. Note that it needs to be larger than at least −10 dB in calculation of an array factor.

Incidentally, in a T-branched type distributor which has been used conventionally, it is difficult to obtain a distribution ratio of −10 dB or less. On the other hand, the distributor 30 illustrated in FIG. 2 can easily obtain the distribution ratio of −10 dB or less. Further, the T-branched type distributor has a drawback that it becomes large in size when it is attempted to obtain a large distribution ratio of −10 dB or less, but the distributor 30 illustrated in FIG. 2 can obtain the distribution ratio of −10 dB or less just by changing the distance between the conductor line 31 and the conductor line 33 as will be described later.

Figure 6:
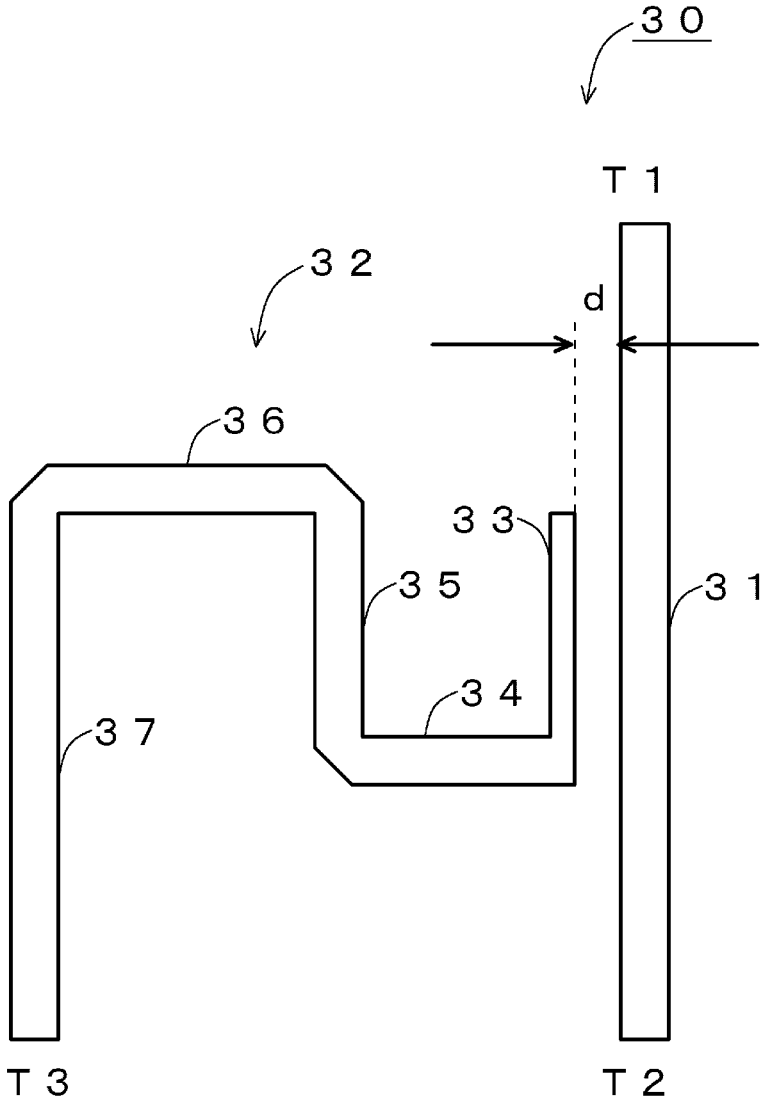
FIG. 6 is a view illustrating details of a distributor illustrated in FIG. 2.
Figure 7:
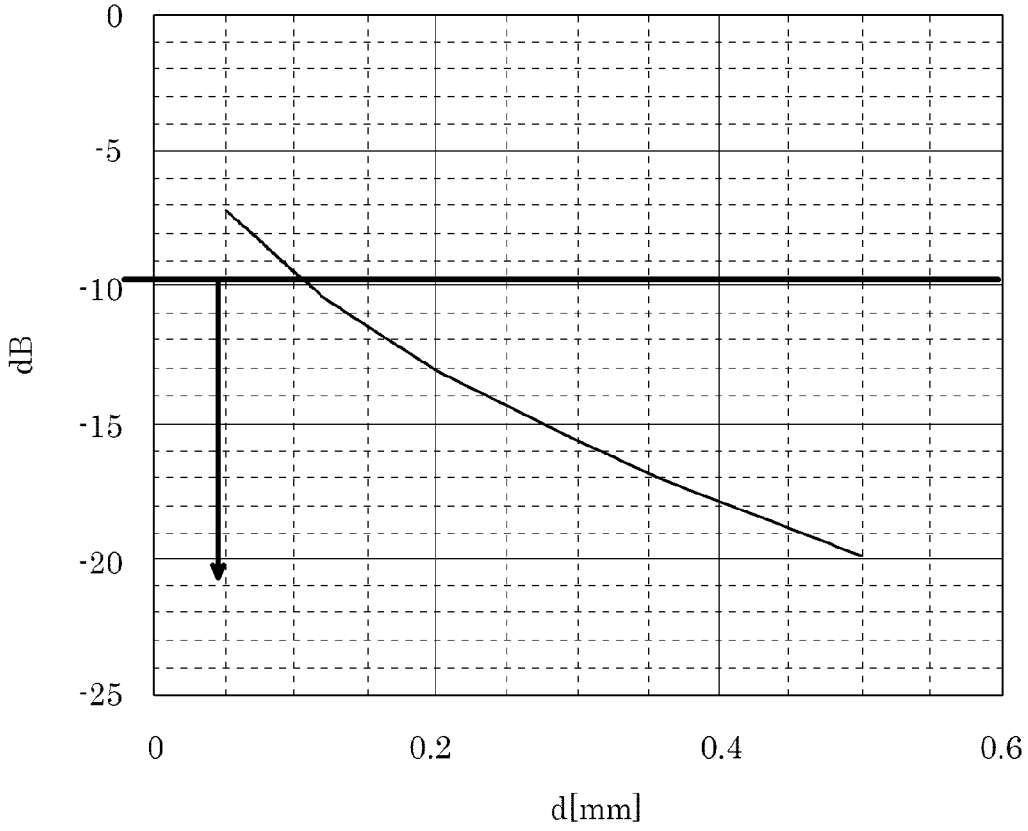
FIG. 7 is a diagram illustrating a change of the power distribution ratio when a distance illustrated in FIG. 6 is changed.

FIG. 6 is a view illustrating a detailed structure of the distributor 30. As illustrated in FIG. 6, the conductor line 31 and the conductor line 33 are formed in parallel across a distance d. Here, given that an upper end (upper end of FIG. 6) of the conductor line 31 is a terminal T1, a lower end of the conductor line 31 is a terminal T2, and a lower end of the conductor line 37 is a terminal T3, when a power distribution ratio (P3/P2) of the power P2 outputted to the terminal T2 and power P3 outputted to the terminal T3 when power is inputted to the terminal T1 is obtained while varying the distance d illustrated in FIG. 6, a graph illustrated in FIG. 7 is obtained. The horizontal axis of FIG. 7 denotes a distance d (mm) and the vertical axis denotes a power distribution ratio (dB). As illustrated in FIG. 7, when the value of distance d increases, the power distribution ratio increases, and when the distance d is 0.1 mm or more, the power distribution ratio (P3/P2) becomes −10 dB or less. Accordingly, in the distributor 30 illustrated in FIG. 6, in order to have a large distribution ratio, it is just necessary to adjust this distance d, which does not cause increase in size of the distributor 30 as in the T-branched type distributor.

Next, operation of the array antenna device 1 will be described with reference to FIG. 1. When power is supplied to the upper end of the conductor line 31 illustrated in FIG. 2, the supplied power is supplied to the series array antenna 10 via the conductor line 31 and the feeding point 14. On the other hand, part of the supplied power is distributed to the conductor line 33 via capacitive coupling between the conductor line 31 and the conductor line 33. Note that this distribution ratio is, for example, set to be −10 dB or less.

The power distributed to the conductor line 33 has its phase delayed in the range of, for example, −135 to −225 deg. with a center at −180 deg. when it is conducted through the conductor lines 34 to 37 having a meander structure, which are the phase adjuster 32. Note that when its main purpose is to radiate a wide-angle beam with the front direction being the center, the delay of the array antenna device 1 is generally set to a reverse phase (180 deg.), but it is set in the range of −135 to −225 deg. because there may be cases where −180 deg. is not optimum depending on design requirements. Further, although setting of the delay in phase is −135 to −225 deg., setting to add ±2 nπ thereto (n: integer) is also applicable.

The power delayed in phase by the conductor lines 34 to 37 which are the phase adjuster 32 is supplied to the series array antenna 20 via the feeding point 24. Thus, power of the power distribution ratio of −10 dB or less having a phase delayed in the range of 135 to 225 deg. as compared to the series array antenna 10 is supplied to the series array antenna 20. As a result, from the array antenna device 1, for example, like the curve to which a numerical value "−18" is given in FIG. 4, radio waves having a small null part in front of the antenna and having flat characteristics are radiated.

As has been described above, in the embodiment of the present invention, since the distributor 30 distributing power via capacitive coupling is formed in a layer different from the series array antennas 10, 20 of the dielectric substrate 2, the power distribution ratio with respect to plural antenna elements can be set large, and even when the radiation pattern is adjusted to a wide angle, an antenna on which nulls do not occur in the vicinity of the front of the antenna can be obtained. Further, to distribute power to the plural antenna elements, losses due to a terminating resistor can be eliminated by not disposing the terminating resistor on the lines, making it possible to improve radiation efficiency of the antenna. Furthermore, by forming the distributor on a layer different from the radiation elements, it is possible to reduce influence on radiation. Further, by using the distributor 30 distributing power via capacitive coupling, the power distribution ratio of −10 dB or less for reducing the null part of gain characteristic can be realized easily with a small size. Further, since the phase adjuster 32 by the conductor lines 34 to 37 having a meander structure is provided between the distributor 30 and the feeding point 24, adjustment of phase can be performed reliably with a simple structure. Further, since the conductor lines 34 to 37 having a meander structure is provided on the series array antenna 20 side that has a smaller power distribution ratio, it can be made insusceptible to the impedance change by the conductor lines 34 to 37 having a meander structure. Further, by providing the conductor lines 34 to 37 having a meander structure on the series array antenna 20 side that has a smaller power distribution ratio, the influence of power loss which occurs due to long lines can be reduced.

Up to here, the direction of the design for reducing the null part, the structural examples of the distributor realizing this characteristic, the characteristic view in FIG. 6, and the characteristic example thereof in FIG. 7 have been described with reference to FIG. 3 and the characteristic example in FIG. 4. However, they are characteristics of the respective parts cut out of this embodiment as a mechanism description of the present proposal. Hereinafter, a characteristic change example in respective dimension parameter changes in this embodiment will be illustrated specifically.

Figure 8:
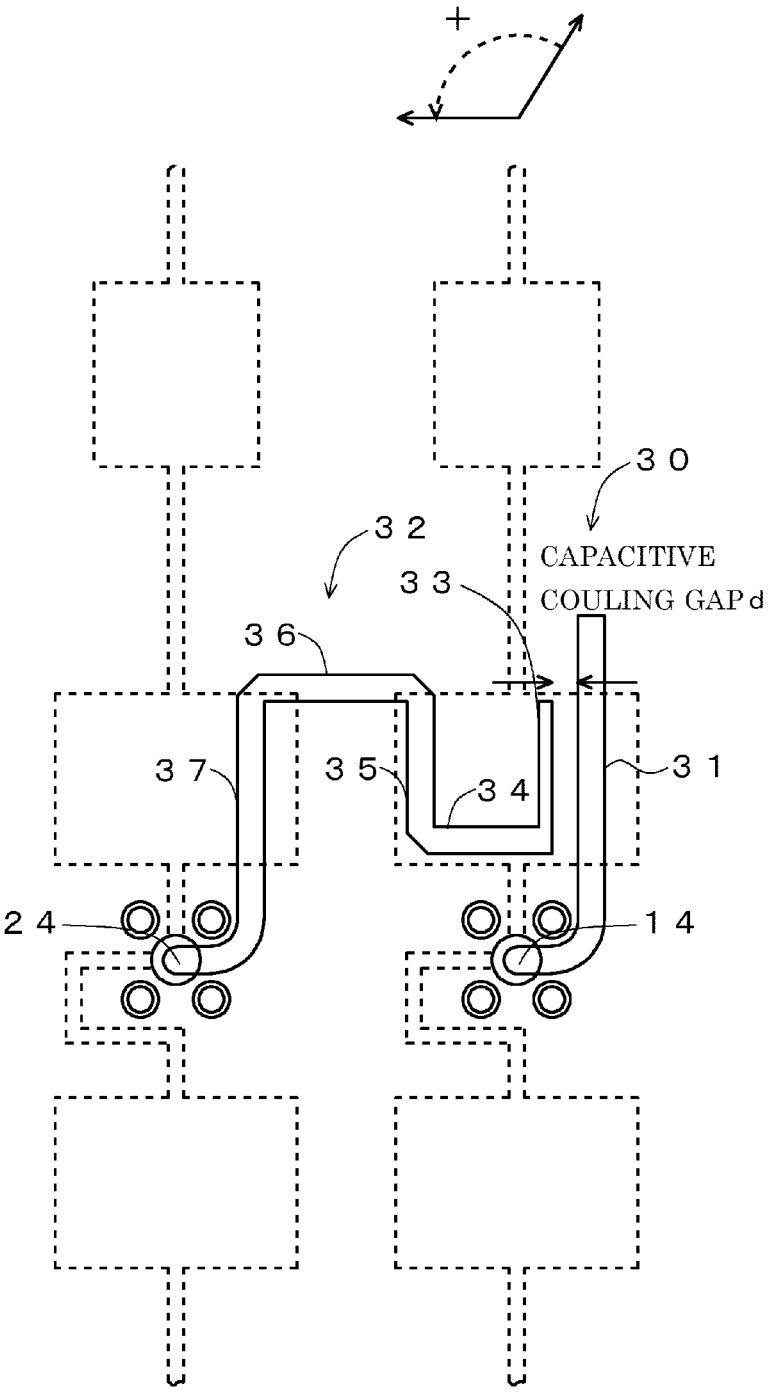
FIG. 8 is a view illustrating the distributor illustrated in FIG. 2 in enlargement.
Figure 9:
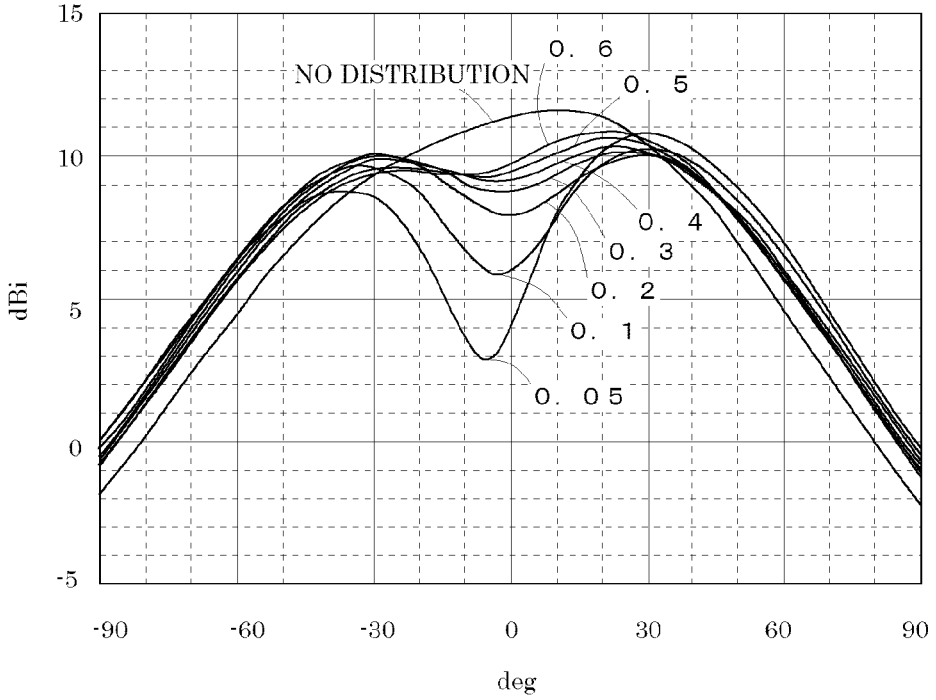
FIG. 9 is a diagram illustrating changes in gain when a capacitive coupling gap illustrated in FIG. 8 is adjusted.

In this embodiment, by adjusting the capacitive coupling distance d illustrated in FIG. 8 as has been described, the size of null can be adjusted as illustrated in FIG. 9. More particularly, the "no distribution" illustrated in FIG. 9 indicates a gain characteristic when only one system of series array antenna is used. Further, numerals 0.6, 0.5, 0.4, . . . , 0.05 given to the respective curves indicate set values of the capacitive coupling distance d in mm units. As illustrated in FIG. 9, as compared to the case of using only one system of series array antenna, the beam angle can be made wider when two systems of series array antennas 10, 20 are used. Further, the size of the null and the beam shape can be adjusted to a certain extent by adjusting the capacitive coupling distance d.

Figure 10:
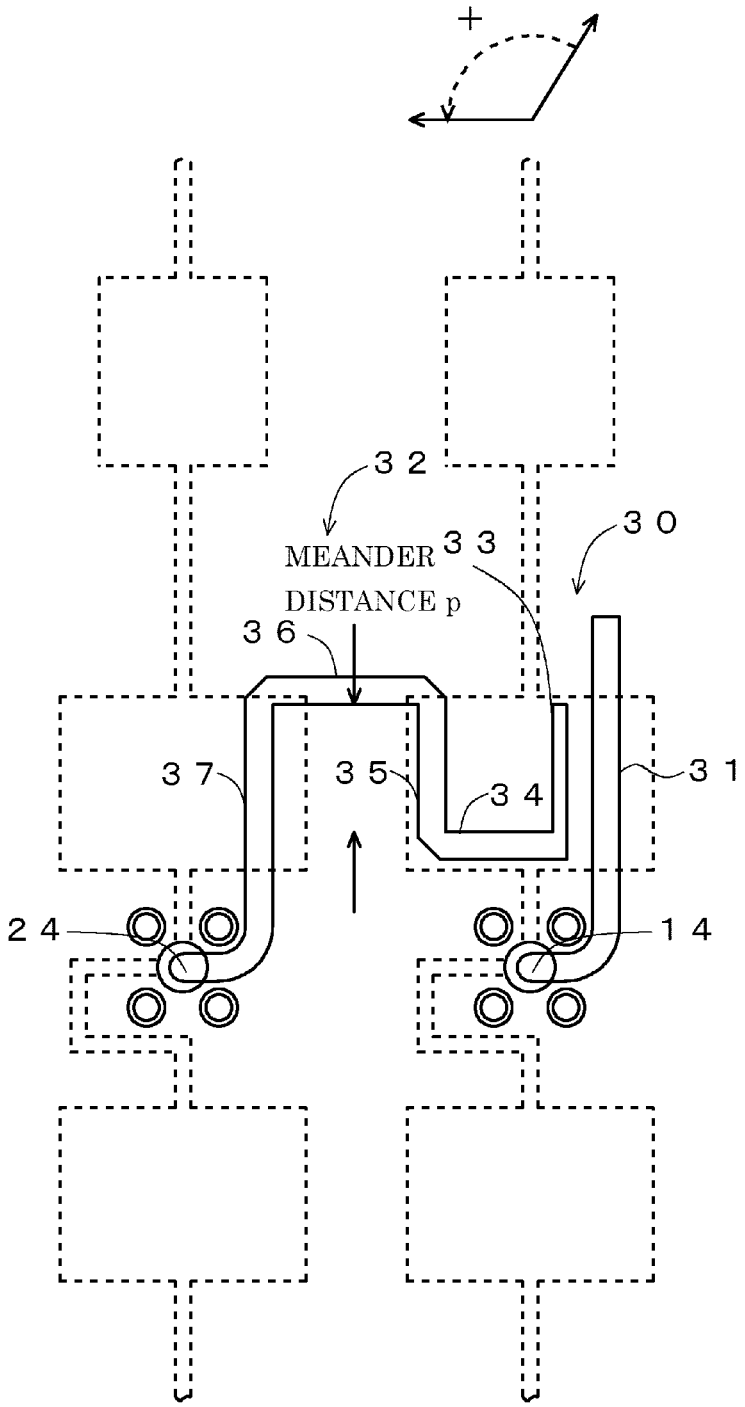
FIG. 10 is a view illustrating the distributor illustrated in FIG. 2 in enlargement.
Figure 11:
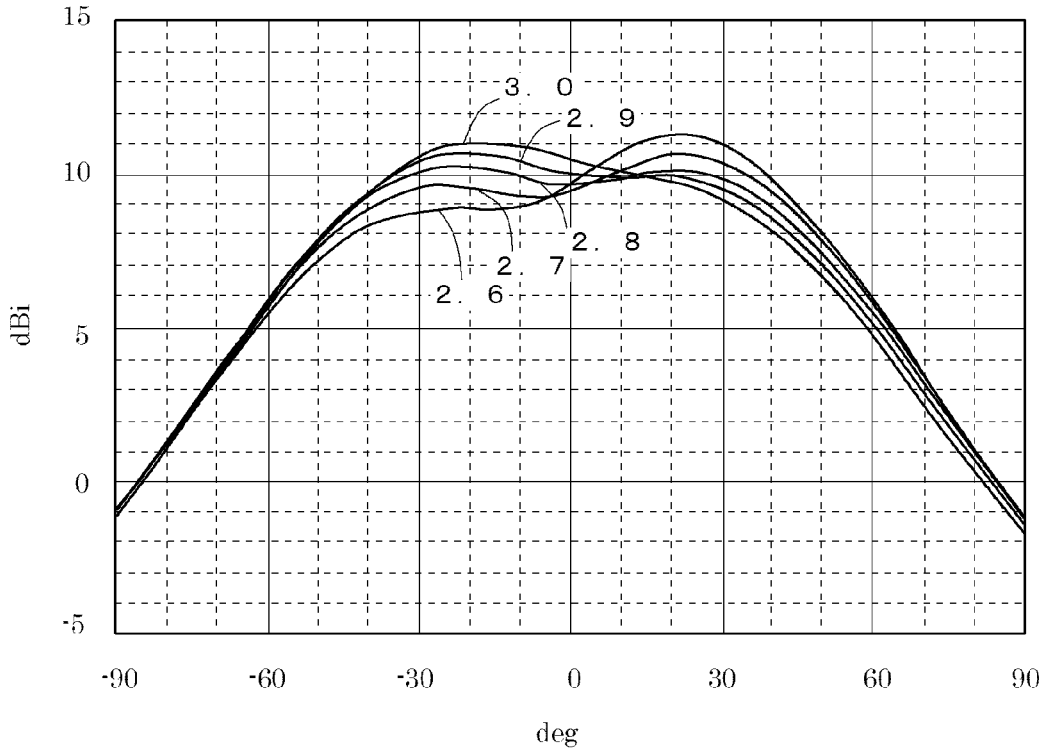
FIG. 11 is a diagram illustrating changes in gain when a meander distance illustrated in FIG. 10 is adjusted.

Further, in this embodiment, by adjusting a meander distance p illustrated in FIG. 10, a beam shape can be adjusted as illustrated in FIG. 11. More specifically, the numerals 3.0, 2.9, 2.8, . . . , 2.6 given to respective curves illustrated in FIG. 11 indicate set values of the meander distance p in mm units. As illustrated in FIG. 11, by adjusting the meander distance p, the shape of the beam can be adjusted. Further, the meander distance p can be adjusted to make the beam have a mostly bilaterally symmetrical shape. Among typical directional couplers, there is a structural example connecting terminating resistors to feeding line ends, but in the distributor of the present proposal, no terminating resistor is connected to the line ends. Thus, it is possible that reflection waves accumulate and a slight displacement from a desired excitation distribution occurs because there is no absorbable part. However, since the directivity formed is only a one-side axis direction and there is a small number of distribution points, that is, reflection sources, and as described above, amplitude and phase adjustment with dimensional parameters are easy, even if there is a displacement from a desired power distribution characteristic by multiple reflections, recovery and directivity adjustment on the design considering this displacement are possible.

Figure 12:
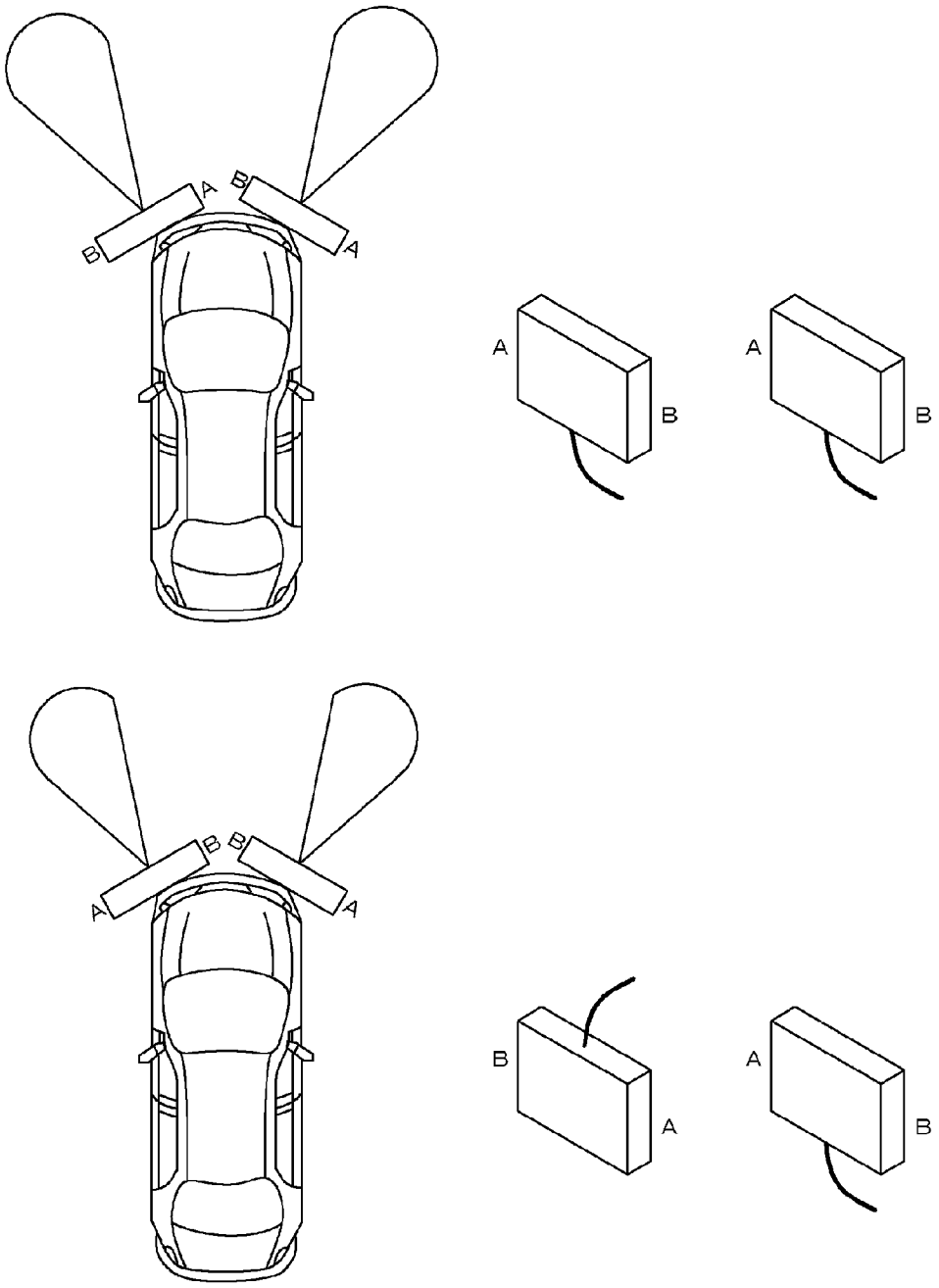
FIG. 12 is a view for describing routing of wires when it is mounted as a radar device in an automobile.

As a merit obtained by having the bilaterally symmetrical beam, for example, when used as antennas of an automobile radar device, it can be easily attached to the vehicle body. More particularly, as illustrated on an upper side of FIG. 12, when the beam is bilaterally symmetrical, attachment directions can be the same, and thus routing of wires can be set in a downward direction in two radar devices. On the other hand, as illustrated on a lower side of FIG. 12, when the beam is not bilaterally symmetrical, in order to radiate bilaterally symmetrical beams from an automobile, one radar device needs to be disposed in a vertically reverse direction, and thus extending directions of wires are reverse between the two radar devices, which makes routing of the wires complicated.

(C) Description of Modification Embodiments

Figure 13:
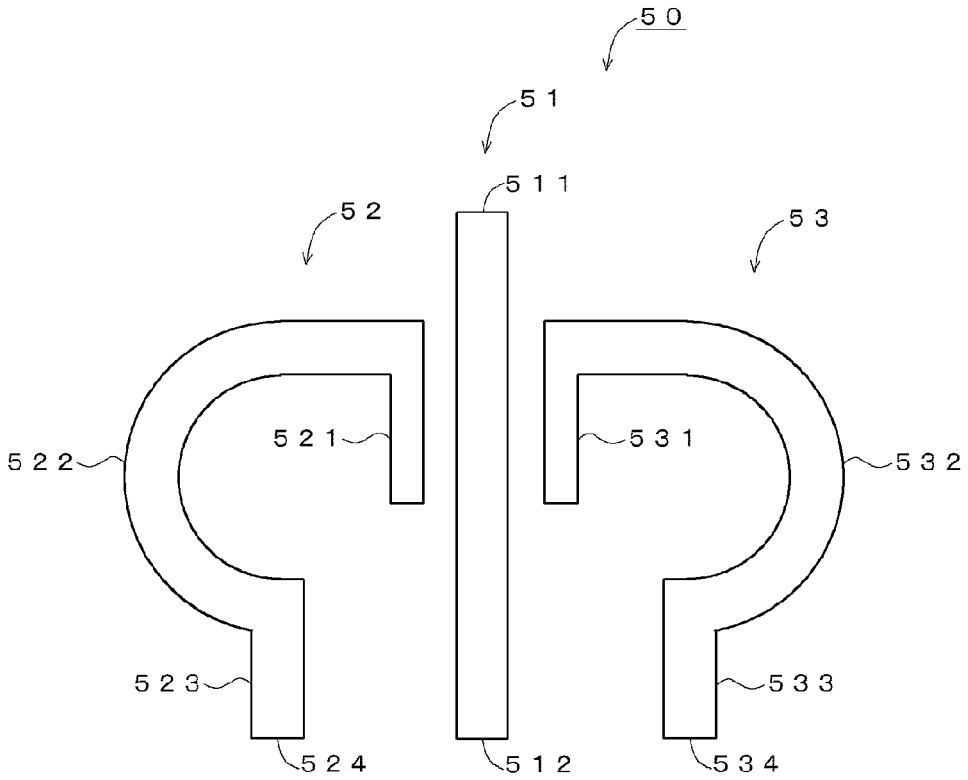
FIG. 13 is a view illustrating another structural example of a distributor.

The above embodiments are examples, and it is needless to mention that the present invention is not limited to the cases as described above. For example, in the above embodiments, two systems of series array antennas 10, 20 are used, but it is also possible to use three or more series array antennas. FIG. 13 is a view illustrating a structural example of a distributor distributing power to three systems of series array antennas. In the example of FIG. 13, the distributor 50 has conductor lines 51 to 53. The conductor line 51 has a straight shape, and power inputted to a terminal 511 is outputted to a terminal 512. This terminal 512 is connected to a feeding point of a first series array antenna (not illustrated). Further, the conductor line 52 has a linear conductor line 521, a curved conductor line 522, and a straight conductor line 523, and the straight conductor line 523 is connected to a feeding point of a second series array antenna (not illustrated). Further, the conductor line 53 has a linear conductor line 531, a curved conductor line 532, and a straight conductor line 533, and the straight conductor line 533 is connected to a feeding point of a third series array antenna (not illustrated). Power inputted to the terminal 511 of the conductor line 51 is supplied to the feeding point of the first series array antenna via the terminal 512. Further, part of the power inputted to the terminal 511 of the conductor line 51 is transmitted to the conductor line 521 via capacitive coupling, delayed by the curved conductor line 522, and thereafter supplied to the second series array antenna via a terminal 524. Further, part of the power inputted to the terminal 511 of the conductor line 51 is transmitted to the conductor line 531 via capacitive coupling, delayed by the curved conductor line 532, and thereafter supplied to the third series array antenna via a terminal 534. Thus, power different in power ratio and phase can be supplied to the three systems of series array antennas. Note that when power is supplied to four or more systems of series array antennas, for example, this can be realized by providing a predetermined number of conductor lines 52, 53 illustrated in FIG. 13.

Figure 14:
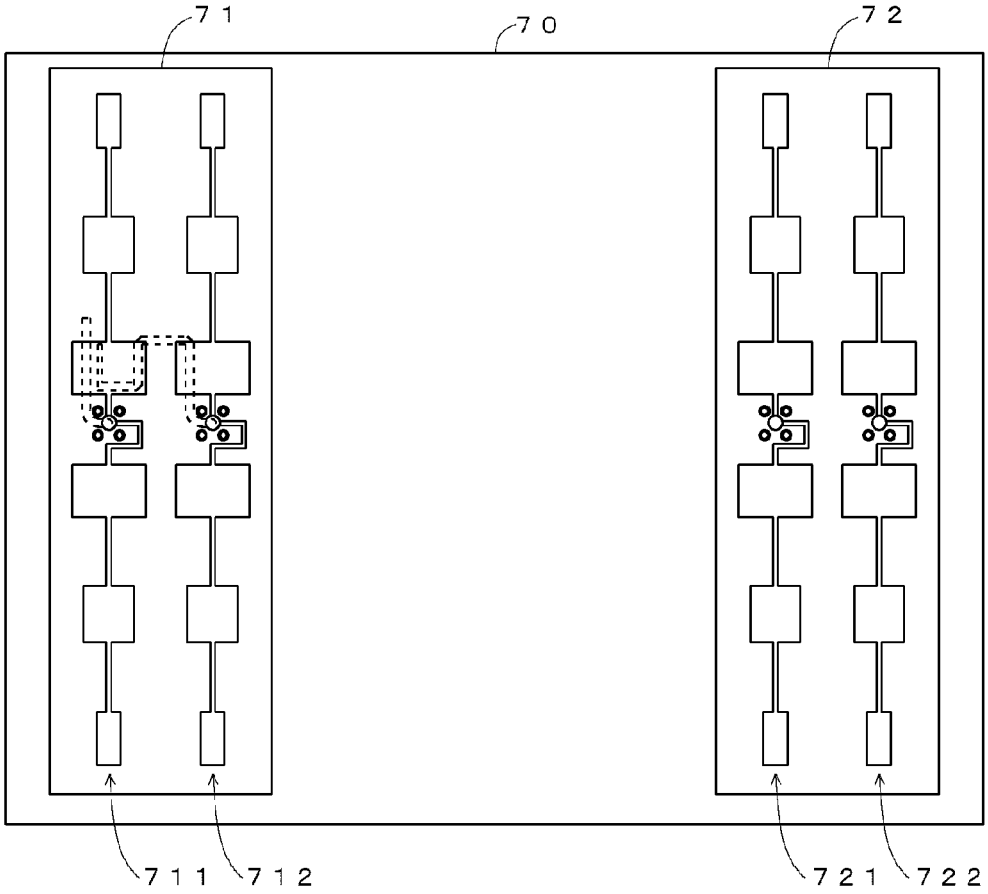
FIG. 14 is a view illustrating an embodiment as a radar device in an automobile.

Further, from the above embodiments, as a minimum structure for obtaining a wide-angle radiation pattern in which no null is generated in the vicinity of the front, the case of using two systems of series array antennas as a transmission antenna is described as an example. On the other hand, angle measurement by a monopulse method using two systems of series array antennas as reception antennas is a publicly known technology in radar systems. Here, by employing a structure having two systems of transmission and two systems of reception, a radar system having a wide detection angle range and capable of performing angle measurement can be obtained with a minimum structure. In an example illustrated in FIG. 14, there are provided a transmission antenna 71 and a reception antenna 72 in a radar device 70 detecting a target object by irradiating the target object with radio waves and detecting reflection waves. Each of the transmission antenna 71 and the reception antenna 72 has two systems of series array antennas 711, 712 and series array antennas 721, 722. By such a structure, the series array antennas can be disposed substantially symmetrically in a horizontal direction. Thus, as compared to conventional structures in which the transmission antenna is one system of array or more than two systems of arrays, a substantially symmetrical structure in a lateral direction in its mechanism can be employed, thereby facilitating mechanism designing and production.

Further, in the above embodiments, the distributor is formed on a surface opposite to the surface of the dielectric substrate on which the series array antennas are formed, but it just needs to be a layer different from the series array antennas. For example, an intermediate layer may be provided on the dielectric substrate, and the distributor may be provided on this intermediate layer.

Figure 15:
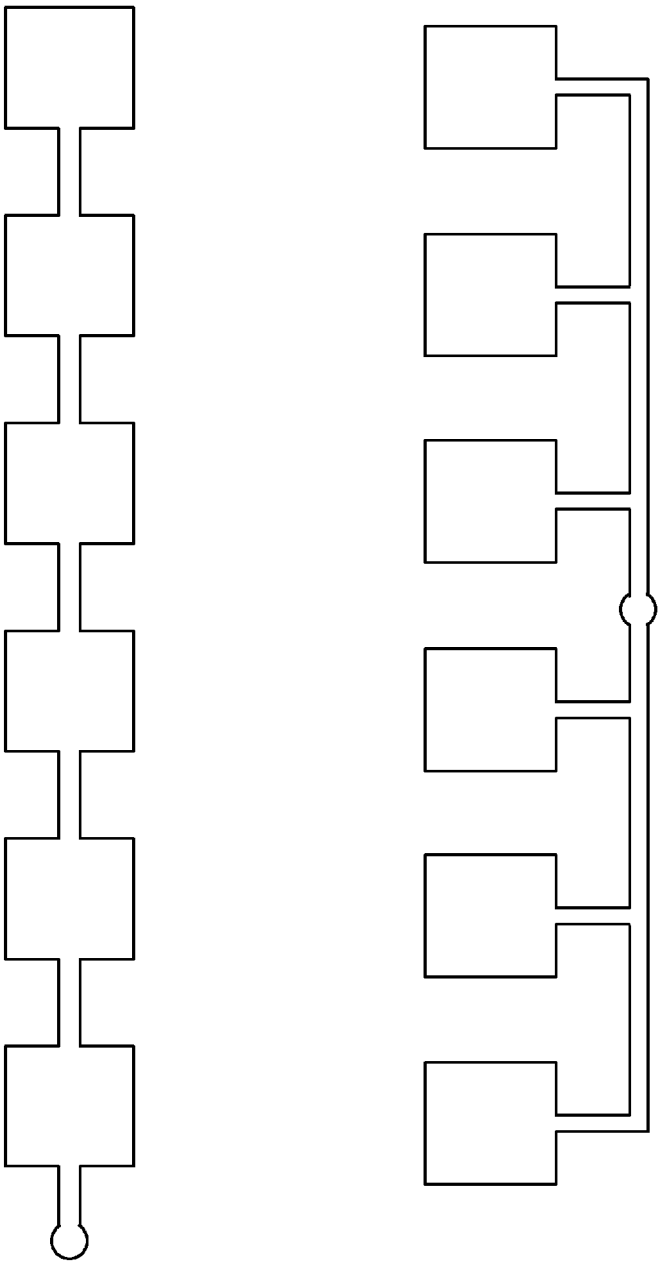
FIG. 15 is a view illustrating another embodiment of the present invention.

Further, in the above embodiments, each series array antenna has six radiation elements, but it may be a number other than this (for example, five or less or seven or more). Further, in each of the above embodiments, the radiation elements have different widths, but radiation elements of the same width may be used. Further, the exemplified one, branching from the array center part to respective opposite directions and connected in series toward the respective opposite directions, is referred to as a series array, but as described on the left side of FIG. 15, it may be one connected in series only in one direction from the feeding point. Further, it is not limited to one in which the excitation direction of elements of the series array antenna is in parallel with the series power supply direction, and may be, for example, a structure in which it is 90 degrees as illustrated on the right side of FIG. 15 or 45 degrees.

Further, in the above embodiments, the phase adjuster is structured of conductor lines having a meander structure at right angles, but for example, it may be a curved structure as illustrated in FIG. 13, or may be a meander structure at angles other than right angles.

Further, in the above embodiments, the case of mounting in an automobile is described as an example, but for example, it is also possible to be used for a radar for security installed in a house or the like.

Explanation of Reference Signs

1 array antenna device
2 dielectric substrate
10, 20 series array antenna
11 to 13, 21 to 23 radiation element
14, 24 feeding point
15, 25 conductor line
30 distributor
31, 33 conductor line
34 to 37 conductor line (phase adjuster)

The invention claimed is:

1. An array antenna device having a plurality of radiation elements, the array antenna device comprising:

a dielectric substrate;

two or more series array antennas formed on the dielectric substrate, the two or more series array antennas consisting of the plurality of radiation elements which are connected in series by conductor lines;

a distributor formed in a layer different from a layer of the dielectric substrate where the series array antennas are formed, the distributor distributing power via capacitive coupling to the two or more series array antennas; and a phase adjuster adjusting a phase of power distributed by the distributor;

wherein:

the phase adjuster is adjusted relatively in a range of substantially reverse phase of −135 to −225 degrees including the distributor as a feeding phase condition to the two or more series array antennas.

2. The array antenna device according to claim 1, wherein the phase adjuster is mounted on an output side where a power distribution ratio of the distributor is relatively small.

3. The array antenna device according to claim 1, wherein a line from an output side where a power distribution ratio of the distributor is relatively small to a feeding point of the series array antennas is longer than a line from an output side where the power distribution ratio is relatively large to the feeding point of the series array antennas.

4. The array antenna device according to claim 1, wherein a power distribution ratio of the distributor is −10 dB or less.

5. The array antenna device according to claim 1, wherein the phase adjuster is formed of lines having a bypass.

6. The array antenna device according to claim 1, wherein each of the radiation elements constituting the series array antennas has a different width.

7. The array antenna device according to claim 1, wherein the two or more series array antennas have a substantially symmetrical gain characteristic when a lining direction of the series array antennas is taken as an axis.

8. The array antenna device according to claim 1, wherein the series array antennas are applied as a transmission antenna of a radar device.

9. The array antenna device according to claim 8, comprising two of the series array antennas as the transmission antenna.

10. The array antenna device according to claim 9, comprising two of the series array antennas as the transmission antenna and two of the series array antennas as a reception antenna.

* * * * *